United States Patent [19]

Tartaglia et al.

[11] 4,315,447

[45] Feb. 16, 1982

[54] NO MAR PLIERS

[76] Inventors: Lawrence Tartaglia, c/o George Spector 3615 Woolworth Bldg., 233 Broadway; George Spector, 3615 Woolworth Bldg., 233 Broadway, both of New York, N.Y. 10007

[21] Appl. No.: 141,045

[22] Filed: Apr. 17, 1980

[51] Int. Cl.[3] ..... B25B 7/02

[52] U.S. Cl. ..... 81/421; 81/425 R; 81/180 B

[58] Field of Search ..... 81/418, 421, 422, 423, 81/425 R, 425 A, 180 B, 180 C, 180 D, 125

[56] References Cited

U.S. PATENT DOCUMENTS

| | | | |
|---|---|---|---|
| 2,404,224 | 7/1946 | Fink | 81/421 |
| 2,528,709 | 11/1950 | Raymond et al. | 81/125 |
| 2,766,649 | 10/1956 | Labby | 81/423 |
| 2,806,396 | 9/1957 | Miller | 81/125 |
| 3,884,282 | 5/1975 | Dobrosielski | 81/125 |

*Primary Examiner*—James L. Jones, Jr.

[57] ABSTRACT

A pair of pliers including a pair of crossing steel levers pivoted on a pivot pin, and a pair of mating jaws at one end of the levers, each of the jaws being lined with an insert made of a tough rubber material in order to grasp a work without marring its surface, and each insert being made of reversible sections in order to selectively present either side thereof toward the work, each of the sides being of a different softness or hardness.

3 Claims, 5 Drawing Figures

NO MAR PLIERS

This invention relates generally to tools such as pliers or wrenches that employ a pair of jaws between which a work may be grasped.

It is well known that a conventional pliers made of metal, can scratch or mar objects, that are gripped between the plier jaws. Accordingly, they are not suitable for holding objects made of polished metal or wood with finished surfaces.

Therefore it is a principal object of the present invention to provide a no-mar pliers which is lined with rubber inserts on each jaw so that the metal of the pliers does not contact the work and mar it.

Another object is to provide a no-mar pliers in which each insert is reversible for selectively presenting either a harder or softer rubber side thereof against the work, as preferred.

Figure 1:
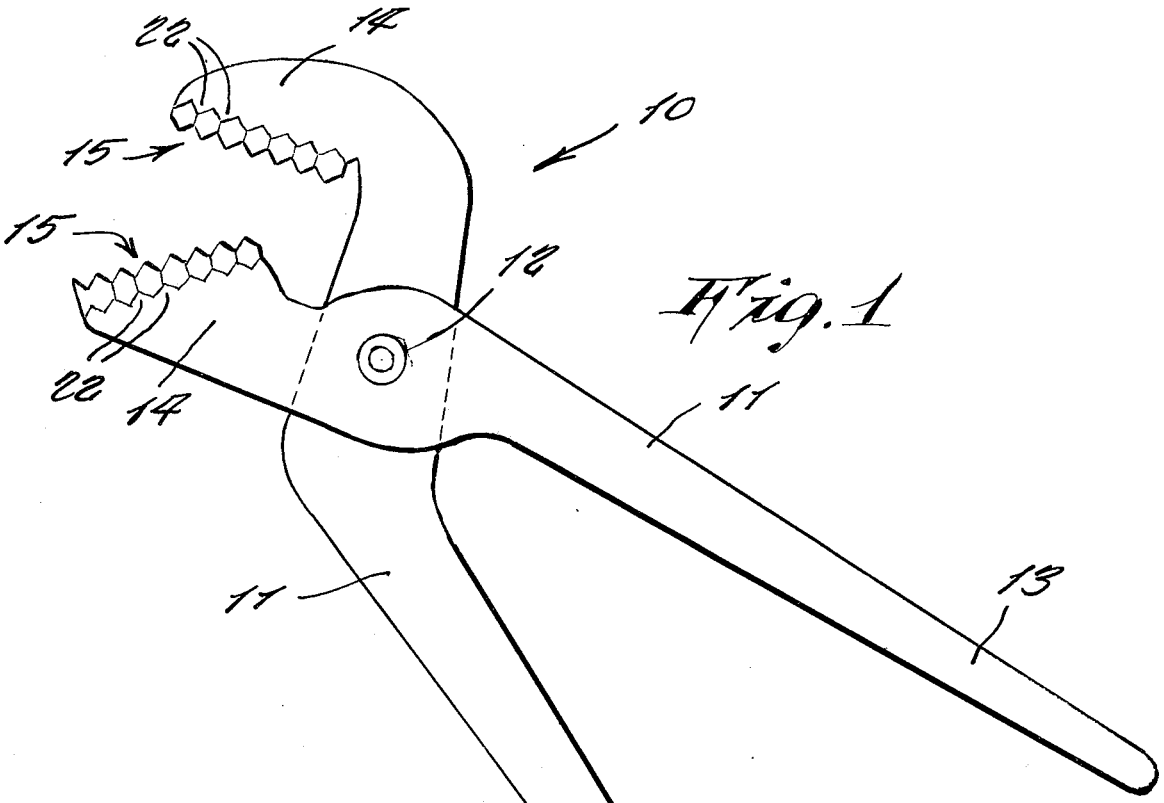
FIG. 1 is a side view of a pliers having rubber pads on each jaw.
Figure 2:
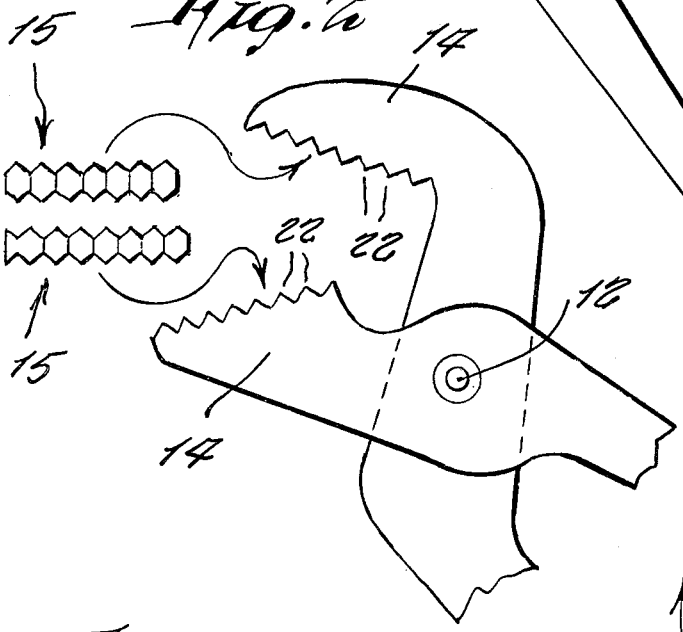
FIG. 2 is a similar view thereof with pads being added to the pliers.

Referring now to the drawings in greater detail, the reference numeral 10 represents, a no-mar pliers according to the present invention, wherein there is a pair of crossing, metal levers 11 which along intermediate portions thereof are pivoted together on a single transverse pivot pin 12. One ends of the levers serves a handles 13 for being squeezed together in a hand and the opposite ends of the levers form a pair of mating jaws 14 between which a work may be grasped firmly.

In the present invention, each jaw is lined with an insert 15 made principally of a rubber material so as to furnish a softer surface against the work and thus not scratch or mar it.

Each insert is made with the rubber material thereof impregnated with magnetic dust or granules 16 so that the inserts will hold firmly to the steel jaws by means of permanent magnetic force.

Figure 3:
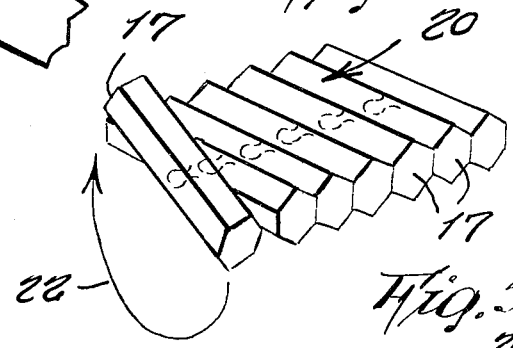
FIG. 3 is a perspective view of one of the pads, and showing a design whereby the pad teeth can be flipped up side down so to present the opposite side teeth in position for engaging a work held by the pliers.
Figure 4:
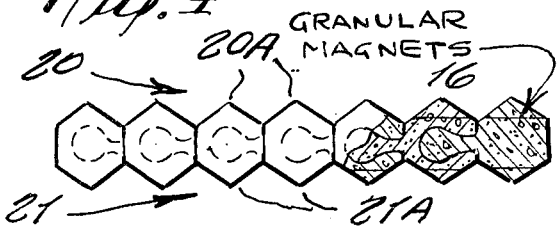
FIG. 4 shows how the teeth units are attached pivotally together, and showing magnetic granules in the rubber pad so to hold to the pliers steel jaws.

Each insert is furthermore made of a plurality of elongated, cross sectionally hexagonal sections 17 which are pivotally attached together by means of a protruding ball 18 molded on one side of a section engaging a spherical socket 19 molded on an adjacent section. The balls and sockets are along a longitudinal center of the sectionals, as shown in FIG. 3.

Thus when the inserts are fully assembled, each forms toothed opposite sides 20 and 21 for selective meshing the teeth 22 of the jaws, and preventing the inserts to slide or slip from the jaws.

Figure 5:
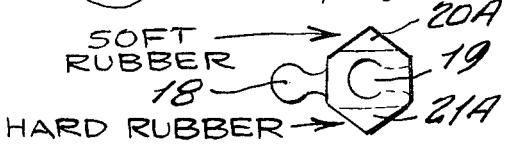
FIG. 5 shows one of the teeth units of the pad, and showing that one tooth of the unit is of softer rubber than the tooth on the opposite side, so a person can flip the teeth as wanted in order that parts of a work can be held more firmly or more gently as preferred, while other parts are held differently firm or gently.

As shown in FIG. 5, each section 17 of each insert is made with a tooth 20A on a side 20 to be of a soft rubber, whereas a tooth 21A on a side 21 is made of a hard rubber. Thus by individually pivoting any section on its ball and socket, it can be turned around as indented by arrow 22 in FIG. 3, so that any portion of an insert facing a work can be made selectively softer or harder, for either a more gentle or more firm grasp of a work. Thus if any portion of a work face is delicate than another portion thereof, any is more liable to be marred, then the corresponding sections of the insert facing it are reversed so that the soft rubber teeth 20A align therewith.

What is claimed as new, is:

1. A no-mar pliers, comprising in combination, a pair of crossing, metal levers, one ends of said levers forming handles for being squeezed together in a hand, an opposite end of said levers forming mating jaws for grasping work therebetween, and each jaw being lined with a removable insert made with molded rubber impregnated with magnetic particles wherein each said insert is made of a plurality of longitudinal, cross sectionally hexagonal sections adjacent each other so to form a toothed face on each opposite side of said insert.

2. The combination as set forth in claim 1 wherein one said toothed face is of a softer rubber than the other said toothed face.

3. The combination as set forth in claim 2 wherein said sections include reversability means.

* * * * *